US005993968A

United States Patent [19]

Umezawa et al.

[11] Patent Number: 5,993,968

[45] Date of Patent: Nov. 30, 1999

[54] WOUND GOLF BALL

[75] Inventors: Junji Umezawa; Shinichi Kakiuchi; Yutaka Masutani, all of Chichibu; Nobuhiko Matsumura; Kunitoshi Ishihara, both of Izumiohtsu, all of Japan

[73] Assignee: Bridgestone Sports Co., Ltd., Tokyo, Japan

[21] Appl. No.: 09/062,641

[22] Filed: Apr. 20, 1998

[30] Foreign Application Priority Data

Apr. 18, 1997 [JP] Japan ..... 9-116450

[51] Int. Cl.[6] ..... A63B 37/12

[52] U.S. Cl. ..... 428/407; 428/423.3; 528/76; 473/354; 473/363; 473/365

[58] Field of Search ..... 473/365, 363; 428/354; 528/407, 423.3, 76

[56] References Cited

U.S. PATENT DOCUMENTS

| | | |
|---|---|---|
| 4,272,079 | 6/1981 | Nakade . |
| 5,733,428 | 3/1998 | Calabria . |
| 5,792,008 | 8/1998 | Kakiuchi . |

FOREIGN PATENT DOCUMENTS

| | | |
|---|---|---|
| 55-47873 | 4/1980 | Japan . |
| 57-115270 | 7/1982 | Japan . |
| 59-129072 | 7/1984 | Japan . |
| 60-210272 | 10/1985 | Japan . |
| 61-112618 | 5/1986 | Japan . |
| 61-112619 | 5/1986 | Japan . |
| 61-290969 | 12/1986 | Japan . |
| 5-73427 | 10/1993 | Japan . |

*Primary Examiner*—David Buttner
*Attorney, Agent, or Firm*—Sughrue, Mion, Zinn, Macpeak & Seas, PLLC

[57] ABSTRACT

A thread-wound golf ball includes a core having a center ball and a rubber thread layer and a cover. The cover is composed primarily of a thermoplastic polyurethane elastomer of an aliphatic and/or alicyclic diisocyanate. The golf ball is prepared by impregnating the rubber thread layer with a urethane dispersion and injection molding the cover over the treated core.

11 Claims, 1 Drawing Sheet

WOUND GOLF BALL

BACKGROUND OF THE INVENTION

1. Field of the Invention

This invention relates to a thread-wound golf ball comprising a thread-wound core composed of a center ball and a layer of rubber thread thereon, and a cover formed over the core.

2. Prior Art

Thread-wound golf balls are conventionally made by winding highly stretched rubber thread onto a liquid center or a solid center to form a rubber thread layer about the center, and forming a cover of balata rubber or ionomer resin over the rubber thread layer.

Compared with two-piece solid golf balls, wound golf balls are preferred by professional golfers and skilled amateurs for their soft "feel" when hit with a golf club and their excellent spin performance (good spin receptivity). Yet, wound golf balls travel a steeper skying trajectory due to backspin, resulting in less carry than two-piece solid golf balls.

Because wound golf balls have a rubber thread layer in which the rubber thread has been stretched 8- to 10-fold and wound, their heat resistance is generally lower than that of two-piece solid golf balls. The possibility that the rubber threads may break under the effect of heat makes it difficult to form the cover by injection molding the cover stock over the wound core. Ways have thus been sought for preventing degradation of the rubber thread layer in the production of wound golf balls, and various solutions have hitherto been proposed.

For example, JP-A 47873/1980 and JP-A 115270/1982 describe the impregnation of a latex containing ionomer resin solids into the rubber thread layer surface, and the molding of the cover stock under applied heat and pressure.

The use of an injection molding process to form the cover in wound golf balls has also been proposed. For example, JP-A 112618/1986 and JP-A 112619/1986 describe the wrapping of a thermoplastic resin film over the rubber thread layer to form a protective layer on the surface thereof. When a cover stock, composed primarily of ionomer resin, is injected over the rubber thread layer, this film protects the rubber thread layer from the heat of the cover stock. However, the cover stock injected here is composed primarily of ionomer resin, which has a relatively low melting point close to 90° C. but a much higher plasticizing temperature of 200° C. Injection molding cannot be carried out without raising the resin temperature to 200° C. Thus, although the above-described treatment of the rubber thread layer surface holds down breakage of the rubber threads, the hot cover stock compromises the properties of the rubber thread through the protective layer or latex, leading to declines in the hardness and initial velocity of the golf ball.

A number of attempts have been made to develop wound golf balls having greater carry. One attempt is to increase the moment of inertia of the golf ball.

The moment of inertia of a golf ball exerts a large influence on such properties during the flight of a golf ball as the trajectory, carry and control of the ball. Increasing the moment of inertia generally serves to lower the attenuation of spin during flight of the ball so that the spin rate is maintained even as the ball passes the peak of its trajectory and descends, making for an elongated trajectory. Moreover, when the ball is putted on a green, a higher moment of inertia increases the straightness of the shot and improves the roll.

Hence, a number of golf balls having large moments of inertia have been proposed (e.g., JP-B 73427/1993, JP-A 129072/1984, and JP-A 210272/1985). More particularly, the moment of inertia is increased by using a cover stock of ionomer resin having blended therein a high specific gravity filler such as white barium sulfate or titanium oxide as disclosed in JP-A 61-290969/1986.

However, because the filled cover stock is less flowing, the cover stock does not readily penetrate the rubber thread layer in the case of wound golf balls, which sometimes results in a lower durability. In addition, other problems include a decrease in resilience and reduced carry, as well as burring and napping of the cover.

Attempts have also been made in which heavy fillers having a specific gravity of 8 or more such as tungsten are blended into the cover formulation. There are limits to the adjustments that can be made by blending in weight-modifying ingredients. In addition, the resulting cover is not satisfactorily white.

Cover resins have also been the subject of various investigations. Thermosetting polyurethane elastomers are often used as substitutes for balata rubber or ionomer resin because of their relatively low cost and their good feel and scuff resistance (e.g., U.S. Pat. Nos. 4,123,061, 3,989,568, and 5,334,673).

Such thermoset polyurethane elastomers are superior in terms of scuff resistance, which is a shortcoming of soft blends of ionomer resins. However, after the starting materials have been poured, curing reactions and other complex operations must be carried out, making the adaptation of this technology to mass production quite difficult. Moreover, when only aliphatic isocyanate is used in the thermosetting polyurethane elastomer, the curing reaction rate is too slow. The use of some aromatic isocyanate is desirable for speeding up the reaction rate. The use of aromatic isocyanate, however, causes the cover to yellow with time. Even if a white enamel coating is applied to the outside of the ball to hide this, the appearance and color of the ball deteriorate as the urethane cover yellows.

Covers made of thermoplastic polyurethane elastomer have also been investigated (e.g., U.S. Pat. Nos. 3,395,109, 4,248,432 and 4,442,282). Although thermoplastic polyurethane elastomers improve the scuff resistance when the ball is hit with an iron club, as well as the moldability and other properties, there has yet to be obtained a sufficient improvement in flight distance due to an increased moment of inertia. Hence, the development of a golf ball with a thermoplastic polyurethane elastomer cover having even higher performance and quality has been awaited.

On the basis of studies aimed at improving the performance of wound golf balls by enhancing the moment of inertia, the present inventors proposed in U.S. Ser. No. 08/841,559 now U.S. Pat. No. 5,800,286 and Ser. No. 08/841,677 now U.S. Pat. No. 5,792,008 which are assigned to the same assignee as the present invention, golf balls with covers in which the primary component is a non-yellowing thermoplastic polyurethane elastomer. Owing to the increased moment of inertia, these wound golf balls offer a longer carry and excellent control, as well as excellent scuff resistance on iron shots, yellowing resistance, and moldability. Even so, there remains a desire for wound golf balls having even higher performance and quality.

SUMMARY OF THE INVENTION

An object of the present invention is to provide a thread-wound golf ball which further improves the fairly good characteristics of the above-described thread-wound golf balls, and which allows for the use of a relatively simple injection molding process in forming the cover over the wound core.

In the present invention, there is provided a thread-wound golf ball comprising a wound core and a cover. The wound core is composed of a center ball and a layer of rubber thread wound onto the center ball. The cover is composed primarily of a thermoplastic polyurethane elastomer of an aliphatic and/or alicyclic diisocyanate. The golf ball is prepared by impregnating the surface of the rubber thread layer with a urethane dispersion and injection molding the cover thereon.

More particularly, the wound golf ball includes a wound core composed of a center ball and a layer of rubber thread wound onto the center ball and a cover enclosing the core. A thermoplastic polyurethane elastomer of an aliphatic and/or alicyclic diisocyanate is used as the main component in the cover resin. The rubber thread layer on the surface is impregnated with a urethane dispersion before the cover stock is injection molded thereon. The resulting golf ball offers a number of significant advantages over the prior art. Specifically, the urethane dispersion immobilizes the ends of the windings in the rubber thread layer, preventing the rubber threads from unraveling. The urethane dispersion has the additional advantages that, compared with the prior art technique involving impregnation with an ionomer dispersion, a higher moment of inertia can be achieved, and a low hardness of the urethane dispersion after drying makes it possible to maintain the hitting feel of a wound golf ball. A high resilience and a longer carry are additionally provided. The inventors have further discovered that injection molding can be carried out at temperatures near 180° C. because the inventive wound golf ball is formed using the above-described thermoplastic polyurethane elastomer in the cover stock. Owing to the high softening point of the urethane dispersion compared with ionomer dispersions, the problems that arise when golf balls are left at high temperatures in the trunk of a car during the summer, for example, can be avoided. In addition to these outstanding benefits, the thread-wound golf ball of the present invention has advantages including an effectively increased moment of inertia, an enhanced flight stability, a much longer distance and improved control, as well as the advantages that the cover composed primarily of a thermoplastic polyurethane elastomer of an aliphatic and/or aromatic diisocyanate effectively suppresses napping and burring of the ball surface, minimizes yellowing of the cover surface over time, and has excellent scuff resistance on iron shots.

BRIEF DESCRIPTION OF THE DRAWING

The objects, features and advantages of the invention will become more apparent from the following detailed description when read in connection with the accompanying drawing.

DETAILED DESCRIPTION OF THE INVENTION

Figure 1:
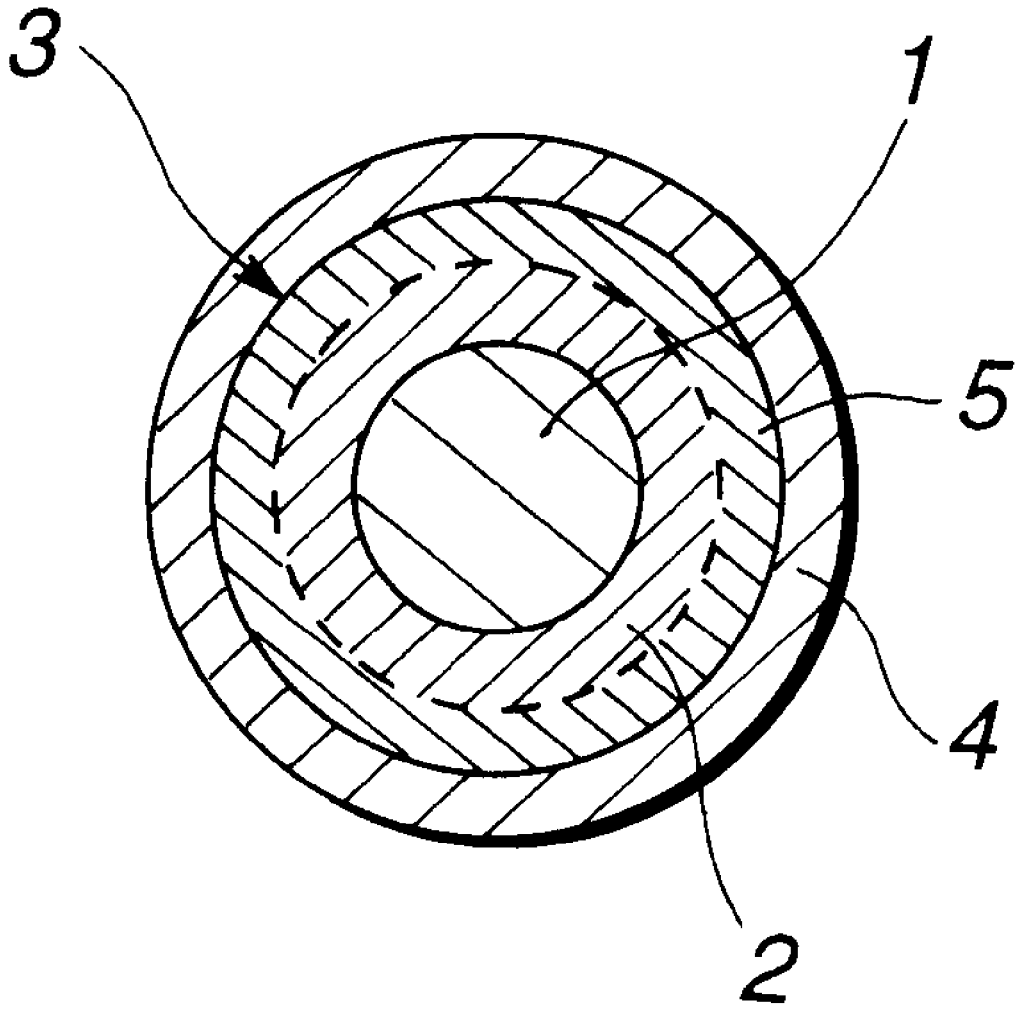
FIG. 1 is a cross-sectional view of a wound golf ball according to the present invention.

Referring to FIG. 1, the thread-wound golf ball according to the invention is comprised of a wound core 3 made up of a center ball 1 and a rubber thread layer 2 enclosing the periphery of the center ball, and a cover 4 enclosing the wound core 3. A thermoplastic polyurethane elastomer of an aliphatic and/or alicyclic diisocyanate is used as the main component of the cover resin. The golf ball is obtained by impregnating the surface of the rubber thread layer 2 with a urethane dispersion to form an impregnated portion 5, and then injection molding the cover stock over the wound core 3 to form the cover 4.

The cover resin used in the present invention is a thermoplastic polyurethane elastomer of an aliphatic and/or alicyclic diisocyanate because it is appropriate from the standpoint of flight performance such as carry, feel of the ball when hit, yellowing resistance of the ball surface, and other considerations.

This thermoplastic polyurethane elastomer has a molecular structure consisting of a high molecular weight polyol compound as soft segments, a molecular chain extender as hard segments, and a diisocyanate.

The high molecular weight polyol compounds include, without particular limitation, polyester polyols, polycarbonate polyols and polyether polyols. Suitable polyester polyols include polycaprolactone glycol, poly(ethylene-1,4-adipate) glycol, poly(butylene-1,4-adipate) glycol and poly (diethylene glycol adipate) glycol. A suitable polycarbonate polyol is (hexanediol-1,6-carbonate) glycol, and a suitable polyether polyol is polyoxytetramethylene glycol. The number-average molecular weight of these polymeric polyols is preferably about 600 to 5,000, and more preferably about 1,000 to 3,000.

Chain extenders that may be used include, without particular limitation, conventional polyhydric alcohols and amines. Suitable examples include 1,4-butylene glycol, 1,2-ethylene glycol, 1,3-propylene glycol, 1,6-hexylene glycol, 1,3-butylene glycol, dicyclohexylmethanediamine (hydrogenated MDA), and isophoronediamine (IPDA). The number-average molecular weight of these is preferably about 200 to 15,000.

To provide the cover with yellowing resistance, use is made of an aliphatic or an alicyclic diisocyanate as the diisocyanate component. Suitable examples include such aliphatic diisocyanates as hexamethylene diisocyanate (HDI), 2,2,4- and 2,4,4-trimethylhexamethylene diisocyanate (TMDI), and lysine diisocyanate (LDI); and such alicyclic diisocyanates as dicyclohexyl diisocyanate ($H_{12}MDI$). The use of hexamethylene diisocyanate (HDI) is especially preferable.

No particular limits are imposed on the melting point of the thermoplastic polyurethane elastomer in the first embodiment, although a melting point of 100 to 200° C., especially 110 to 180° C. is appropriate to assure desirable heat resistance and processing characteristics.

Illustrative examples of the thermoplastic polyurethane elastomer include those having the trade names Pandex T-7298 and Pandex T-7890, both manufactured by Dainippon Ink & Chemicals, Inc.

Other thermoplastic resins may be blended as suitable in the above-described thermoplastic polyurethane elastomer. Examples of the other thermoplastic resins include polyamide elastomers, polyester elastomers, ionomers, styrene block elastomers, hydrogenated butadiene, ethylene-vinyl acetate copolymers (EVA), polycarbonates and polyacrylates.

Together with the above resin ingredients, various additives such as pigments, dispersants, antioxidants, ultraviolet absorbers and parting agents may be added in conventional amounts to the cover stock if necessary.

In the present invention, the cover 4 which is composed primarily of the above-described thermoplastic polyurethane elastomer may be formed by suitably selecting and using the above-mentioned components. It is preferable that the cover be formed to have a hardness as measured with a Shore D durometer (hereinafter referred to as the "Shore D hardness") of from 40 to 60, and especially from 42 to 55, and a thickness of 0.8 to 2.5 mm, and especially 1 to 2 mm. At a Shore D hardness of less than 40, the ball may incur too much spin when hit with a golf club, which lowers the carry. On the other hand, at a Shore D hardness of more than 60, the cover may mar easily when hit with an iron, and suitable resilience may not be obtained. Also, a cover thinner than 0.8 mm may shear when topped with an iron. A cover thicker than 2.5 mm may fail to acquire a suitable initial velocity.

No particular limit is imposed on the specific gravity of the cover, although this is preferably 1.0 to 1.40, and more preferably 1.1 to 1.30.

In the present invention, the wound core 3 is obtained by winding rubber thread onto the outside of the center ball 1 to form a rubber thread layer 2. The center ball 1 may be either a solid center or a liquid center.

When a solid center is used as the center ball 1, it may be produced by a known method using a known material composed primarily of cis-1,4-polybutadiene. The solid center preferably has an outside diameter of 28 to 35 mm, and especially 30 to 34 mm. Advantageous use can be made of a solid center having a hardness corresponding to a distortion of 1.5 to 4.5 mm, more preferably 1.8 to 4 mm under a load of 30 kg. Moreover, the weight may be suitably selected without any particular limitation, although the weight is generally 15 to 30 grams, and preferably 17 to 28 grams. The resilience of the solid center should preferably be such that the rebound height when dropped from a height of 120 cm is at least 95 cm, and more preferably 97 to 104 cm.

When the center ball 1 is a liquid center, it may be produced by a conventional method. For example, the liquid center may be obtained by filling a rubber center bag with a liquid. In this case, the liquid center preferably has an outside diameter of 28 to 32 mm, and especially 29 to 31 mm. Preferably the center bag itself has a gage of 1.5 to 3 mm, and a JIS-A hardness of from 45 to 65. Any suitable fill liquid known to the art may be used, and examples include water, sodium sulfate solutions, and pastes obtained by blending zinc oxide or barium sulfate with water.

In the present invention, the specific gravity of the center ball 1 may be the same as or higher than the specific gravity of the cover 4. It is recommended that the difference between the specific gravity of the center ball and the specific gravity of the cover be no more than 0.2, and especially from 0 to 0.15. A difference in specific gravity of greater than 0.2 may fail to achieve a sufficient moment of inertia-increasing effect and, in turn, an increased carry.

The rubber thread layer 2 is formed by winding rubber thread in a highly extended state around the outside of the center ball 1 described above. A conventional thread winding method may be employed for this purpose, and the rubber thread used may be a material familiar to the art. No particular limits are imposed on the specific gravity, width, thickness and other characteristics of the rubber thread, although use is generally made of rubber thread having a specific gravity of 0.93 to 1.1, and especially 0.93 to 1, a width of 1.4 to 2 mm, and especially 1.5 to 1.7 mm, and a thickness of 0.3 to 0.7 mm, and especially 0.4 to 0.6 mm.

In the process of preparing the wound golf ball of the present invention, after the rubber thread layer 2 is formed by winding rubber thread about the center ball 1, the rubber thread layer 2 on the surface is impregnated with a urethane dispersion, thereby forming the impregnated portion 5.

The urethane dispersion used herein may be obtained by uniformly dispersing a polyurethane resin in a medium such as water or an organic solvent. The content of polyurethane resin solids is preferably from 30 to 60% by weight, and more preferably from 30 to 50% by weight though not critical. From the standpoint of the working conditions during golf ball production, an aqueous dispersion is preferred. Preferably the urethane dispersion is dried and cured into a product having a softening point of 80 to 180° C.

Illustrative examples of the polyurethane resin used in the dispersion include Resamine D-2515 and D-6200 available from Dainichi Seika Kogyo K.K., and Hydran HW-970 available from Dainippon Ink & Chemicals, Inc.

Various additives may also be included in the above dispersion, such as thickening agents in an amount of 0.5 to 15% by weight, and preferably 2 to 10% by weight, and polycarboimide crosslinking agents in an amount of 2 to 10% by weight, and preferably 2 to 7% by weight. A suitable thickening agent is carboxylated methyl cellulose. A suitable polycarboimide crosslinking agent is Resamine D-52 available from Dainichi Seika Kogyo K.K.

In the practice of the invention, any of various methods may be used for causing the urethane dispersion to penetrate into the surface of the rubber thread layer 2. Suitable methods include dipping the wound core 3 in the urethane dispersion, and directly spraying the urethane dispersion onto the wound core 3. Although no particular limit is imposed on the amount of urethane dispersion impregnated into the rubber thread layer 2, this is preferably 0.5 to 3.0 grams, and especially 1.0 to 2.5 grams of urethane solids per wound core. The thickness or depth of the impregnated area 5 from the surface of the rubber thread layer 2 is preferably 10 to 100 $\mu$m in order that the impregnated area protect the rubber thread layer 2 during injection molding and also improve the feel of the resulting golf ball when hit with a golf club as well as the ball's moment of inertia.

Once the wound core 3 impregnated with the dispersion has been allowed to dry by standing at room temperature, for example, injection molding of cover stock is carried out by a conventional process, yielding the wound golf ball.

In this invention, the cover stock composed primarily of the specific thermoplastic polyurethane elastomer is injection molded. There are no particular limits on the injection molding conditions. Since the cover stock is composed of the specific thermoplastic polyurethane elastomer, injection molding can generally be carried out at a resin temperature of 170 to 200° C. This avoids the rubber thread breakage and heat degradation of the rubber thread layer that may arise during prior art injection molding using ionomer resin cover stocks.

As with conventional golf balls, the wound golf balls of the invention have numerous dimples formed on the surface. The dimple parameters and arrangement may be optimized to further increase the moment of inertia and thereby improve the flight characteristics.

Thus, dimples may be provided such that, if the golf ball is assumed to be a smooth sphere, the ratio of the surface area of this hypothetical sphere surrounded by the edges of the individual dimples to the entire surface area of the hypothetical sphere is at least 65%, and preferably 70 to 80%. When the percent dimple surface area is less than 65%, it may not be possible to obtain the outstanding flight characteristics, and especially the increased carry, that are described above.

Moreover, the percent dimple volume may be set at 0.76 to 1%, and preferably 0.78 to 0.94%. The percent dimple volume is (total dimple volume)/(ball volume)×100 wherein "ball volume" refers to the volume of the true spherical ball when one imagines the surface of the golf ball to be free of dimples, and "total dimple volume" refers to the sum of the volumes of the individual dimples. When the percent dimple volume is less than 0.76%, the ball may travel a too high trajectory, resulting in a shorter carry. When the dimple volume ratio is greater than 1%, the trajectory may become too low, similarly resulting in a shorter carry.

The number of dimples is preferably from 350 to 500, more preferably from 370 to 480, and most preferably from 390 to 450. When the number of dimples is less than 350, the diameter of a dimple becomes too large, resulting in a decrease in the true sphericity of the ball. When the ball has more than 500 dimples, the diameter of a dimple becomes so small that the aerodynamic effect of dimples essentially vanishes. No limits are imposed on the diameter, depth and cross-sectional shape of dimples, although the diameter may generally be set within a range of 1.4 to 2.2 mm and the depth may generally be set within a range of 0.15 to 0.25 mm. Two or more types of dimples having different diameters, depths and the like may be formed. There are no particular limits on the manner in which the dimples are arranged. For example, known arrangements such as regular octahedral, regular dodecahedral and regular icosahedral arrangements may be employed. Moreover, any of various patterns such as square, hexagonal, pentagonal and triangular patterns may be formed on the ball surface by the dimple arrangement.

The inventive wound golf balls constructed as described above preferably have a ball hardness corresponding to a distortion of 2.4 to 3.6 mm, and especially 2.6 to 3.4 mm under a load of 100 kg.

Golf tournaments are conducted under the same rules and regulations throughout the world. The golf balls of the present invention must, as a matter of course, accord with golf regulations relating to weight, diameter, symmetry and initial velocity. Thus, the weight may be suitably set at not greater than 45.93 g, the diameter at not less than 42.67 mm, and the initial velocity at not greater than 76.2 m/s when measured with an R&A-approved apparatus (a maximum tolerance of 2%, 77.7 m/s; the temperature of ball when tested, 23±1° C.).

There has been described the wound golf ball wherein a cover stock composed primarily of a thermoplastic polyurethane elastomer of an aliphatic and/or alicyclic diisocyanate is injection molded over a rubber thread layer whose surface has been impregnated with a urethane dispersion, to form the cover. This makes for excellent moldability that allows injection molding to be carried out at a low temperature setting within the mold. Moreover, the resulting golf ball has an increased moment of inertia and thus a longer carry, as well as excellent control, scuff resistance when hit with an iron, and yellowing resistance.

EXAMPLE

Examples of the invention are given below by way of illustration, and are not intended to limit the invention. All parts are by weight.

Examples 1–4 and Comparative Examples 1–3

The solid center compositions shown in Table 1 were kneaded, then molded and vulcanized at 155° C. for 15 minutes in a mold, thereby obtaining four types of solid centers (A to D).

The diameter, weight, specific gravity and hardness (expressed by a distortion under a load of 30 kg) for each of the resulting center balls were measured. The results are shown in Table 1.

TABLE 1

| | Center balls | A | B | C | D |
|---|---|---|---|---|---|
| Blended amounts (parts by weight) | cis-1,4-Polybutadiene rubber | 100.0 | 100.0 | 100.0 | 100.0 |
| | Zinc acrylate | 20.0 | 20.0 | 20.0 | 20.0 |
| | Zinc oxide | 16.5 | 23.0 | 28.0 | 23.0 |
| | Barium sulfate | 17.0 | 23.0 | 28.0 | 23.0 |
| | Dicumyl peroxide | 1.2 | 1.2 | 1.2 | 1.2 |
| After vulcanization | Diameter (mm) | 32.0 | 31.9 | 32.0 | 29.8 |
| | Weight (g) | 20.9 | 21.8 | 23.0 | 17.8 |
| | Specific gravity | 1.21 | 1.28 | 1.35 | 1.28 |
| | Hardness (mm) | 1.95 | 2.00 | 1.90 | 1.90 |

Rubber thread of the following formulation was wound onto the above center balls by a conventional winding method, thereby obtaining wound cores having an outside diameter of about 39 mm and a distortion of about 3 mm under a load of 100 kg.

| Rubber Thread Composition and Dimensions | |
|---|---|
| Polyisoprene rubber | 70 parts |
| Natural rubber | 30 parts |
| Zinc oxide | 1.5 parts |
| Stearic acid | 1 part |
| Vulcanizing accelerator | 1.5 parts |
| Sulfur | 1 part |
| Specific gravity: 0.93 | |
| Rubber thread dimensions: width 1.55 mm, thickness 0.55 mm | |

Next, using the polyurethane resin or ionomer resin dispersions having the compositions shown in Table 2, the dispersion was impregnated into the wound core by method (1) or (2) described below, then dried for 24 hours. Dipping treatment was not carried out on the core in Comparative Example 1. The weight and thickness of a deposit measured as described below are shown in Table 4.

Application Methods:

(1) The wound core was dipped in a dispersion and impregnation treated for 30 seconds using a vacuum pump.

(2) The wound core was dipped in a dispersion and left to stand therein for 30 seconds, then drawn out.

Deposit Weight:

This was the increase in weight due to impregnation with the dispersion, as obtained by subtracting the weight of the wound core before dipping treatment from the weight of the wound core after treatment.

Deposit Thickness:

This was calculated by subtracting the outside diameter of the wound core before dipping treatment from the outside diameter of the wound core after it was dipped in the dispersion and dried.

TABLE 2

| Type of dispersion | | A | B | C |
|---|---|---|---|---|
| Blended amounts (parts by weight) | Resamine D-6028[1)] | 100 | | |
| | Resamine D-6200[2)] | | 100 | |
| | Resamine D-52[3)] | 5 | 5 | |
| | Chemipearl SA-100[4)] | | | 100 |
| Solids (%) | | 40 | 30 | 35 |

TABLE 2-continued

| Type of dispersion | A | B | C |
|---|---|---|---|
| Viscosity (cp) | 240 | 100 | 50 |
| Hardness (Shore D)[5] | 37 | 47 | 45 |
| Softening point (° C.)[6] | 145 | 170 | 55 |

[1]Resamine D-6208: A urethane dispersion (Dainichi Seika Kogyo K.K.).
[2]Resamine D-6200: A urethane dispersion (Dainichi Seika Kogyo K.K.).
[3]Resamine D-52: A urethane dispersion crosslinking agent (Dainichi Seika Kogyo K.K.).
[4]Chemipearl SA-100: An ionomer dispersion (Mitsui Petro-Chemical Industry K.K.).
[5]The hardness was the value measured after drying the dispersion as a sheet.
[6]The softening point was the value measured after drying the dispersion as a sheet.

The cover ingredients shown in Table 3 were kneaded, and cover stocks having cover compositions A and B were injected over the wound core at the molding temperatures shown in Table 4, thereby producing wound golf balls.

TABLE 3

| | Cover | | |
|---|---|---|---|
| Type of cover | | A | B |
| Blended amounts (parts by weight) | Pandex T-7298[1] | 100 | |
| | Surlyn 8120[2] | | 100 |
| | Titanium oxide | 5 | 5 |
| | Magnesium stearate | 0.5 | 0.5 |
| Specific gravity | | 1.21 | 0.97 |
| Shore D hardness | | 48 | 45 |

[1]Pandex T-7298: A thermoplastic polyurethane elastomer of aliphatic diisocyanate (Dainippon Ink & Chemicals, Inc.).
[2]Surlyn 8120: An ionomer resin (E. I. du Pont de Nemours & Co., Inc.).

At the same time as injection molding, dimples were formed on the surfaces of the balls in a regular octahedral arrangement. The number of dimples was 392 (in three sizes), the percent dimple surface area was 77%, and the percent dimple volume was 0.9%.

The resulting golf balls were evaluated by the test methods described below. The results are shown in Table 4.

Ball Hardness

A load of 100 kg was applied to the ball, and the amount of distortion (mm) was measured. A larger numerical value indicates a softer ball.

Moment of Inertia

The natural frequency X was measured with a moment of inertia measuring instrument (manufactured by Inertia Dynamics Inc.). The moment of inertia was computed by inserting this measurement X into the following formula.

$$M = \frac{AX(B^2 - C^2)}{(D^2 - E^2)}$$

M: Moment of inertia

A: Constant (=1.12)

B: Natural frequency of ball

C: Natural frequency with empty mounting fixture

D: Natural frequency with calibrated weight

E: No-load natural frequency

Flight Test

Using a swing robot machine, the spin rate, initial velocity, angle of elevation, carry, and total distance were measured when the ball was hit with a driver (w#1) at a head speed of 45 m/s (HS=45).

Rejection Rate on Molding

Out of 100 balls molded, the number of balls in which rubber thread was visible on the surface of the cover plus balls in which the coverage of the cover stock was incomplete was counted. The results are indicated in percent.

TABLE 4

| | Examples of the Invention | | | | Comparative Examples | | |
|---|---|---|---|---|---|---|---|
| | 1 | 2 | 3 | 4 | 1 | 2 | 3 |
| Center Ball | | | | | | | |
| Formulation | A | B | B | D | C | C | C |
| Diameter (mm) | 32.0 | 31.9 | 31.9 | 29.8 | 32.0 | 32.0 | 32.0 |
| Weight (g) | 20.7 | 21.8 | 21.8 | 17.8 | 23.0 | 23.0 | 23.0 |
| Hardness (mm) | 1.95 | 2.00 | 2.00 | 1.90 | 1.90 | 1.90 | 1.90 |
| Specific gravity | 1.21 | 1.28 | 1.28 | 1.28 | 1.35 | 1.35 | 1.35 |
| Dispersion | | | | | | | |
| Formulation | A | A | B | A | — | C | C |
| Method of application | (1) | (2) | (1) | (1) | — | (1) | (1) |
| Deposit weight (g) | 2.2 | 1.1 | 1.2 | 2.0 | — | 1.5 | 1.5 |
| Deposit thickness (mm) | 0.05 | 0.04 | 0.01 | 0.05 | — | 0.01 | 0.01 |
| Cover | | | | | | | |
| Formulation | A | A | A | A | A | B | A |
| Thickness (mm) | 1.8 | 1.8 | 1.8 | 1.8 | 1.8 | 1.8 | 1.8 |
| Weight (g) | 12.0 | 12.1 | 12.1 | 12.2 | 12.0 | 10.3 | 12.1 |
| Hardness (Shore D) | 48 | 48 | 48 | 48 | 48 | 45 | 48 |
| Specific gravity | 1.21 | 1.21 | 1.21 | 1.21 | 1.21 | 0.97 | 1.21 |
| Injection temperature (° C.) | 185 | 185 | 185 | 185 | 185 | 210 | 185 |
| Ball | | | | | | | |
| Diameter (mm) | 42.68 | 42.69 | 42.68 | 42.69 | 42.68 | 42.70 | 42.69 |
| Weight (g) | 45.2 | 45.3 | 45.4 | 45.1 | 45.2 | 45.0 | 45.3 |
| Hardness (mm) | 2.95 | 3.00 | 2.96 | 3.02 | 3.11 | 3.22 | 2.91 |
| Moment of inertia ($g \cdot cm^2$) | 82.6 | 81.6 | 81.5 | 81.0 | 81.3 | 79.2 | 81.7 |
| W#1 HS = 45 | | | | | | | |
| Spin (rpm) | 2800 | 2850 | 2800 | 2950 | 2750 | 2930 | 2820 |
| Initial velocity (m/s) | 65.6 | 65.5 | 65.3 | 65.5 | 65.2 | 64.8 | 65.0 |
| Angle of elevation (°) | 12.0 | 12.0 | 11.9 | 12.2 | 11.9 | 11.7 | 11.7 |
| Carry (m) | 208.3 | 208.0 | 207.5 | 209.4 | 206.3 | 204.9 | 204.5 |
| Total distance (m) | 218.5 | 218.4 | 218.9 | 217.8 | 216.7 | 214.0 | 215.5 |
| Moldability | | | | | | | |
| Rejection rate (%) | 0 | 1 | 0 | 0 | 22 | 5 | 0 |

It is apparent from the above results that the wound golf balls of the first embodiment of the invention have good moldability and a high initial velocity and flight distance. By contrast, the wound golf balls in which the wound core was not dispersion-treated (Comparative Example 1) had a high injection molding rejection rate, and even the acceptable golf balls had lower initial velocities and shorter flight distances. In the wound golf balls obtained by impregnating the surface of the rubber thread layer with an ionomer dispersion and forming thereover a cover composed primarily of ionomer resin (Comparative Example 2), both the hardness and the flight distance were low because injection molding could not be carried out unless the temperature within the mold was high. Moreover, in the wound golf balls obtained by impregnating the rubber thread layer of the wound core with an ionomer dispersion and forming a cover composed primarily of non-yellowing thermoplastic polyurethane elastomer onto the wound core (Comparative Example 3), the adhesion between the cover and the rubber thread layer was poor, resulting in a lower initial velocity and flight distance.

Although some preferred embodiments have been described, many modifications and variations may be made thereto in light of the above teachings. It is therefore to be understood that the invention may be practiced otherwise than as specifically described without departing from the scope of the appended claims.

We claim:

1. A thread-wound golf ball comprising;

a wound core composed of a center ball and a layer of rubber thread wound onto the center ball and a cover enclosing said core, said cover being composed primarily of a thermoplastic polyurethane elastomer of an aliphatic and/or alicyclic diisocyanate, said golf ball being prepared by impregnating the surface of said rubber thread layer with a urethane dispersion and injection molding the cover thereon.

2. The thread-wound golf ball of claim 1 wherein the cover has a Shore D hardness of 40 to 60 and a thickness of 0.8 to 2.5 mm.

3. The thread-wound golf ball of claim 1 wherein the urethane dispersion contains 30 to 60% by weight of polyurethane resin solids.

4. The thread-wound golf ball of claim 1 wherein the center ball has an outside diameter of 28 to 35 mm.

5. The thread-wound golf ball of claim 1, wherein the cover has a Shore D 42 to 55 and a thickness in the range of 1 to 2 mm.

6. The thread-wound golf ball of claim 1, wherein said cover has a specific gravity in the range of 1.0 to 1.40.

7. The thread-wound golf ball of claim 1, wherein said golf ball has a distortion in the range of 2.4 to 3.6 mm under a load of 100 kg.

8. The thread-wound golf ball of claim 1, wherein said thread rubber has a specific gravity in the range of 0.93 to 1.0, a width in the range of 1.4 to 2.0 mm and thickness in the range of 0.3 to 0.7 mm.

9. The thread-wound golf ball of claim 1, wherein said center ball comprises a rubber center bag filled with liquid.

10. The thread-wound golf ball of claim 1, wherein said center bag has a gage of 1.5 to 3 mm and JIS-A hardness in the range of 45 to 65.

11. The thread-wound golf ball of claim 1, wherein a difference between the center of gravity of the center ball and the center of gravity of the cover is no more than 0.2.

* * * * *